US007108401B1

(12) United States Patent
Kane et al.

(10) Patent No.: US 7,108,401 B1
(45) Date of Patent: Sep. 19, 2006

(54) SHUTTER LOCK FOR SPECIALIZED LIGHTING FIXTURES

(75) Inventors: Kenneth M. Kane, Trumbull, CT (US); Frank Cogliano, Suffern, NY (US)

(73) Assignee: Lighting Services, Inc., Stony Point, NY (US)

( * ) Notice: Subject to any disclaimer, the term of this patent is extended or adjusted under 35 U.S.C. 154(b) by 91 days.

(21) Appl. No.: 10/783,503

(22) Filed: Feb. 20, 2004

(51) Int. Cl.
*F21V 17/02* (2006.01)

(52) U.S. Cl. ..... 362/321; 362/281; 362/283; 362/322; 362/323

(58) Field of Classification Search ..... 362/284, 362/281, 283, 321, 322, 323
See application file for complete search history.

(56) References Cited

U.S. PATENT DOCUMENTS 4,210,955 A * 7/1980 Labrum ..... 362/321

2002/0060911 A1* 5/2002 Brockmann et al. ..... 362/321

* cited by examiner

*Primary Examiner*—Stephen F Husar
*Assistant Examiner*—Meghan K. Dunwiddie
(74) *Attorney, Agent, or Firm*—Schweitzer Cornman Gross & Bondell LLP

(57) ABSTRACT

A specialized lighting fixture, such as a framing projector provided with a plurality of adjustable framing shutters, is modified to incorporate a pair of locking rings, surrounding the body of the lighting fixture and positioned on opposite sides of outwardly projecting portions of the framing shutters. After initial adjustment of the framing shutters has been completed, the locking rings are tightly compressed together, as by locking screws positioned between adjacent pairs of framing shutters, to lock the shutters in position against unintended dislodgment. For lighting fixtures of non-uniform shape, the locking rings may be made in two parts, preferably hinged together, which are secured together after being positioned on the housing of the lighting fixture. The locking rings are particularly adapted for retrofit installation on lighting fixtures of existing design.

7 Claims, 3 Drawing Sheets

SHUTTER LOCK FOR SPECIALIZED LIGHTING FIXTURES

BACKGROUND OF INVENTION

For theatrical lighting, and for various applications of specialized commercial lighting, it is a common practice to utilize special lighting fixtures occasionally track mounted but more frequently mounted in other ways, which can be aimed and focused on a particular area. Such lighting fixtures typically incorporate a relatively high intensity light source, one or more focusing lenses, and provisions to accommodate accessory cartridges with filters, etc. for achieving a variety of specific lighting effects. Many such lighting fixtures also incorporate adjustable framing shutters that are movable to positions partially blocking and shaping the light source. Typically, there are a plurality of such shutters, for example four, spaced around the circumference around the lighting fixture. These are adapted to be manually adjusted inward and outward with respect to the center line of the lighting fixture, and also to be tilted, all for the purpose of enabling the light discharged from the fixture to be rather precisely shaped and confined, such that it may be directed with a considerable degree of precision at a particular object area to be illuminated.

Framing shutters for lighting fixtures of the type described above advantageously can include a shutter panel, which projects more or less radially into the interior of the lamp housing. The shutter is formed of relatively thin sheet metal and typically has an integral extension arm projecting generally radially outward of the lamp housing and mounting a handle at its outer end. Friction elements act on the shutter plates, tending to hold them in any position in which they are set.

In a typical setup operation, a lighting technician will aim and focus the lighting fixture and, in conjunction therewith, will shift the framing shutters radially inward or outward, and perhaps tilt one or more of them in their planes, with the end result that the focused beam is both confined and shaped in a manner calculated to achieve a desired effect.

In many, if not most, situations, once a lighting fixture has been aimed, focused and the light beam suitably shaped and confined with the framing shutters, it may be expected to remain in that setting for an extended period of time (e.g., weeks or months). In many cases, however, the lighting fixture may be subject to bumping, jarring, vibration, etc., which can have the effect of shifting one or more of the framing shutters from its originally adjusted position. This can occur over a period of time, as where the fixture may be subject to a vibrational environment, or it may happen more abruptly if a handle of a framing shutter is accidentally bumped.

DESCRIPTION OF PREFERRED EMBODIMENTS OF THE INVENTION

In accordance with the present invention, a simplified and inexpensive positive locking arrangement is provided for the framing shutters of a specialized lighting fixture, such that once the framing shutters have been adjusted to suit the installing artist or technician, the framing shutters can be effectively permanently locked in their adjusted positions until intentionally moved after releasing the shutter locking means.

In its basic form, the shutter lock device of the invention comprises a pair of ring-like elements that are received over the exterior of the lamp housing, in a close fitting relation thereto, completely or substantially completely surrounding the lamp housing, with one ring being positioned on each side of outwardly projecting portions of the framing shutters. The two ring-like elements, sometimes referred to herein as locking rings, are secured together at a plurality of circumferentially spaced points by means of locking screws, by which significant clamping pressure may be brought to bear between the two locking rings. For the initial adjustment of the framing shutters, the locking rings are released by loosening the screws, to provide a relatively loose fitting relation with the framing shutters. However, once the shutters have been positioned to the satisfaction of the technician, the locking screws are tightened, and the locking rings bear against the framing shutters with considerable force to securely lock them in their adjusted positions.

The shutter lock feature of the present invention can be incorporated into a specialized lighting fixture of the type described at a minimum additional cost, while solving a long-standing problem with respect to unintended loss of shutter adjustment over time from vibration and other causes. In addition, the device of the invention can easily be installed as a retrofit on existing fixtures, in order to upgrade usefulness of such fixtures.

In its simplest form, the shutter lock is simply two circular rings joined at multiple points by a plurality of circumferentially spaced locking screws. Where the shape of the lamp housing and/or the production procedures of the lighting fixture are appropriate, a pair of closed circular rings may be installed by sliding them over the lamp housing to positions on opposite sides of the framing shutters. Otherwise, the locking rings may be formed as semi-circular pairs, to accommodate retrofit installations. In such a case, the locking screws may serve a dual function, providing a means for joining the ring parts, as well as performing their regular clamping/locking functions.

For a more complete understanding of the above and other features and advantages of the invention, reference should be made to the following detailed description of preferred embodiments of the invention, and to the accompanying drawings.

DESCRIPTION OF PREFERRED EMBODIMENTS

Figure 1:
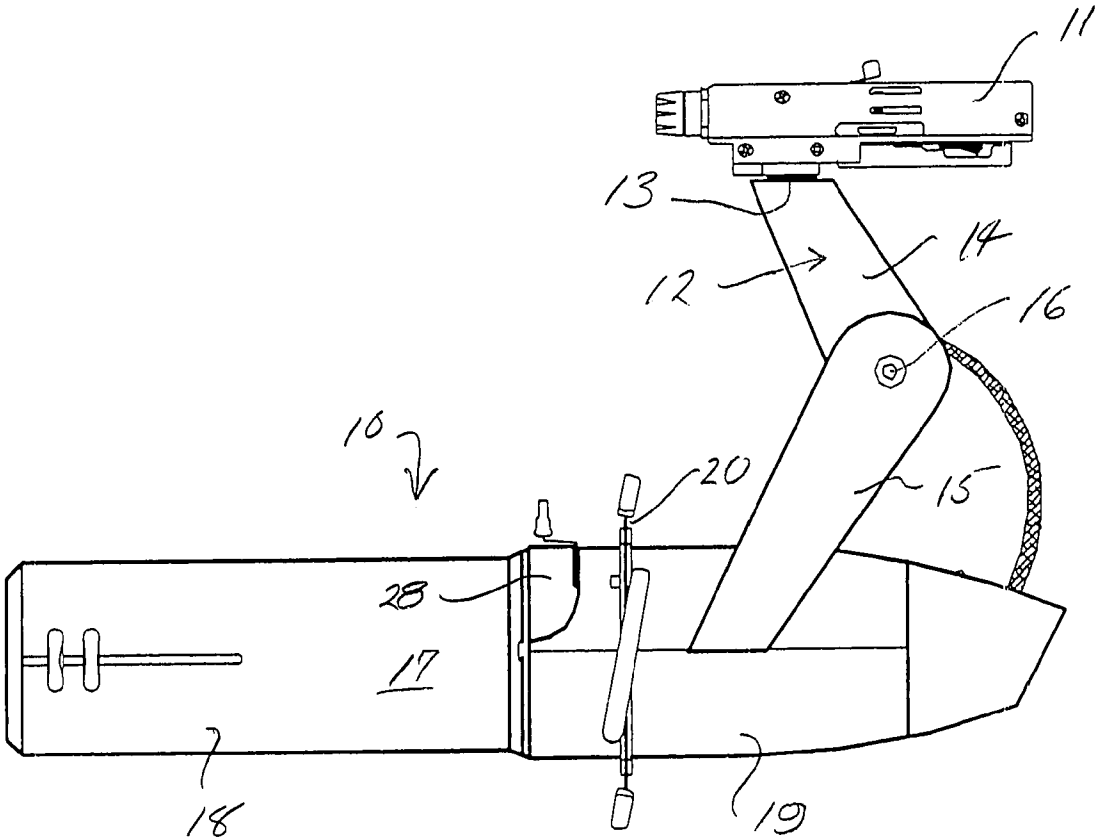
FIG. 1 is a side elevational view of a lighting fixture, such as a framing projector, incorporating the principles of the invention.
Figure 2:
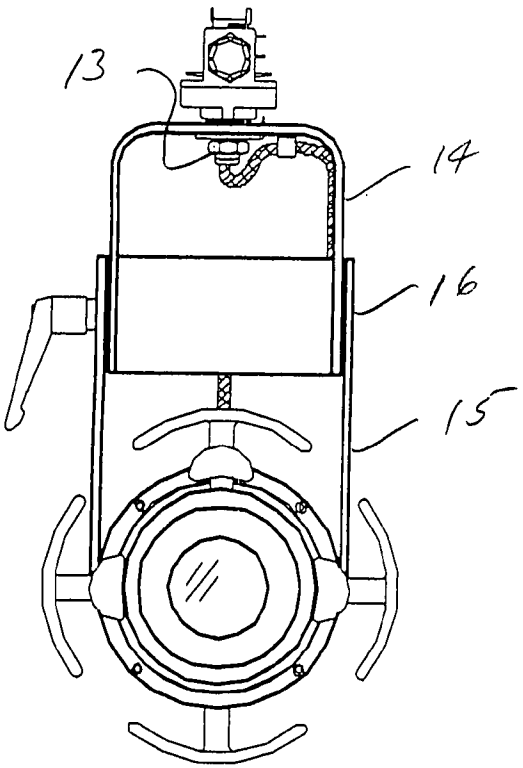
FIG. 2 is a front elevational of the fixture of FIG. 1.

Referring now to the drawings, the reference numeral 10 designates generally a specialized lighting fixture for theatrical or commercial lighting such as, for example, the BP75 framing projector as manufactured by Lighting Services, Inc., of Stony Point, N.Y. The illustrated fixture is specifically intended for track mounting, and therefore includes a track mount housing 11 from which extends a support bracket 12. The bracket 12 is pivotally mounted at 13 to the housing 11, for rotation about a vertical axis, and is formed in upper and lower parts 14, 15 pivoted at 16 for rotational adjustment about a horizontal axis.

In the illustrated form of the invention, the main housing 17 of the lighting fixture comprises front and back portions 18, 19. The back portion 19, which is attached to the lower bracket elements 15, houses a light source (not shown) in the back portion thereof, a plurality of framing shutters 20 in front of the light source, and an accessory 28 which is removably received at the front of the housing portion 19. The front barrel portion 18 of the lamp housing may contain focusing lenses.

Figure 3:
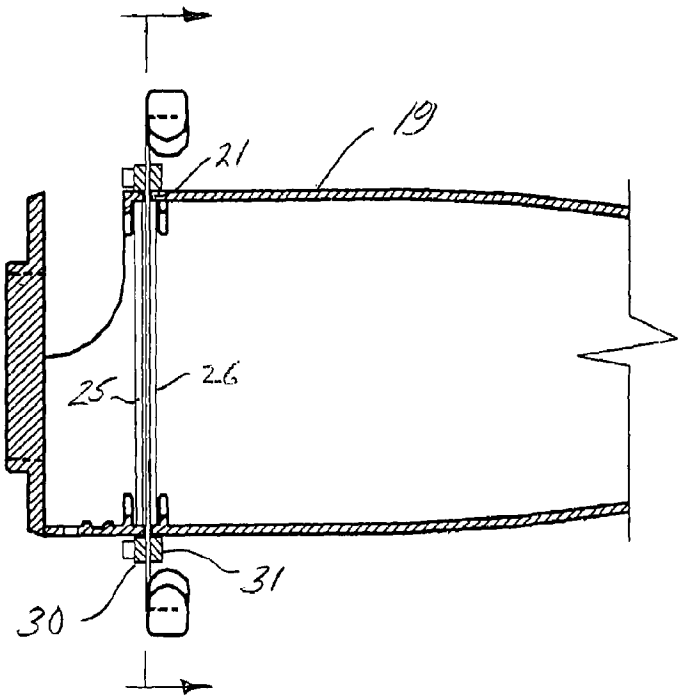
FIG. 3 is a partial longitudinal cross sectional view showing features of the lamp housing, framing shutters and shutter lock of the fixture of FIG. 1.
Figure 4:
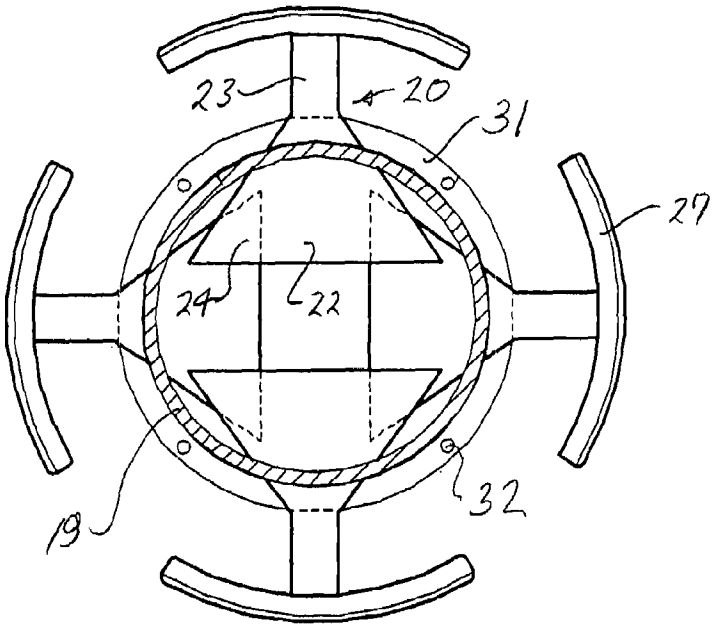
FIG. 4 is a transverse cross sectional view as taken generally at line 4—4 of FIG. 3.

With reference to FIGS. 3 and 4, the rear housing portion 19 is formed with a plurality of circumferential slots 21 for the reception of a plurality of the framing shutters 20. In the illustrated structure, there are four framing shutters 20, arranged generally at right angles with respect to each other. The framing shutters are formed of sections of flat, relatively thin sheet metal blades 22 which are shaped to provide an outwardly extending stem portion 23, and a somewhat triangularly shaped internal portion 24. The shutter blades 22 are frictionally gripped by internal flanges 25, 26 (FIG. 3) which allow the shutter blades to be manipulated radially of the housing 19, and also to be tilted, if desired. Once adjusted, the shutter blades 22 are retained in their adjusted positions by the frictional grip of the flanges 25, 26. Each of the shutters is provided with an external handle portion 27 which allows it to be gripped for accomplishing the desired adjusting motions.

In a typical case, the lighting fixture initially may be set up on location with the intent that it remain in its adjusted condition for a considerable period of time. However, the framing shutters 20 may be subject to unintended dislocation over time, as through vibration, being accidentally bumped, etc. In accordance with the present invention, such dislocations are avoided by incorporating into the lamp structure, either in the initial production or as a retrofit accessory, a positive locking means for reliably retaining the framing shutters in their preadjusted positions until intentionally released for readjustment.

Figure 6:
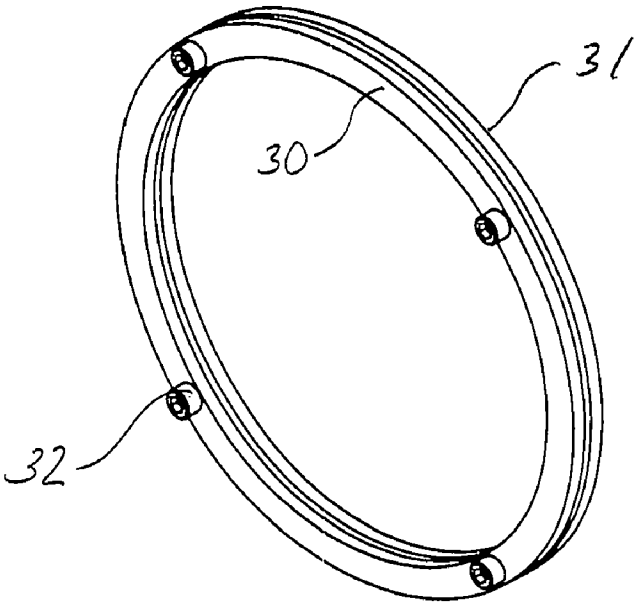
FIG. 6 is a perspective view of the locking device of FIG. 5 in its assembled condition.
Figure 5:
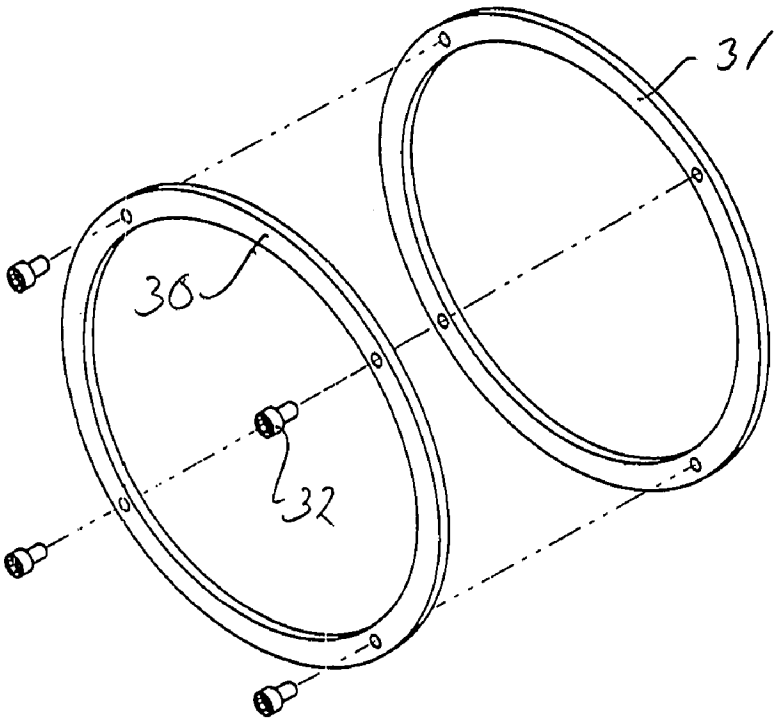
FIG. 5 is an exploded view of the shutter locking device of the invention.

In the illustrated form of the invention, the shutter locking means advantageously comprises a pair of locking rings 30, 31 (FIGS. 5 and 6) which are joined together at a plurality of circumferentially spaced points by means of locking screws 32. Preferably, the locking rings 30, 31 are shaped and sized to conform closely to the exterior of the rear lamp housing 19. In the illustrated case, the housing 13 is circular, as are the locking rings 30, 31. The rings 30, 31 can be installed by first removing the framing shutters 20 from the slots 21 in which they are normally retained and sliding the rings 30, 31 over the lamp housing to position one ring on each side of the shutter slots 21. The framing shutters are then re-inserted in their slots, between the shutter plates 22, with the locking screws loosened or removed.

When the locking screws 32 are in a loosened condition, the framing shutters 20 may be manipulated and adjusted in the usual manner. Once the shutters have been adjusted to the satisfaction of the technician, however, the locking screws 32 are tightened to securely lock the shutters in their as-adjusted positions until such time as the locking rings are released. The adjusted positions of the framing shutters will not be affected by typical vibration, accidental jostling, etc.

In the specifically illustrated embodiment of the invention, both the lamp housing 19 and the locking rings 30, 31 are of circular configuration. However, if the lamp housing is of a non-circular configuration, or elements incorporated with the lamp housing must be accommodated, the clamping rings can be formed of an appropriate shape to accommodate other configurations. Additionally, it is not necessary that the locking rings make contact with the lamp housing throughout its entire periphery, but only that there is contact at enough positions to locate the locking rings relative to the housing portion 19.

In the illustrated form of the invention, it has been found sufficient to utilize four locking screws 32 spaced such that, in the installed arrangement, there is a locking screw positioned between each adjacent pair of framing shutters 20, as reflected in FIG. 4. In the contemplated forms of the invention, there is sufficient stiffness in the material of the clamping rings 30, 31 to enable fully effective locking action to be achieved using a single screw between each pair of framing shutters. For example, for a framing projector of around three inches in diameter, clamping rings formed of steel plate, of about 3/32 inch in thickness, are suitable. For projectors of larger size, the clamping rings of correspondingly heavier construction may be appropriate.

In some instances, the configuration of the lamp housing 17 may not readily accommodate the reception of locking rings of a closed configuration for a retrofit installation of a shutter locking facility. For such cases, the locking rings may be made in two parts (e.g., semi-circular instead of circular in case of the locking rings shown in FIGS. 5 and 6) with certain of the locking screws 32 being utilized in a dual capacity, as clamping/locking screws and also to join two half sections together after they are positioned around the lamp housing.

The device of the invention results in a significant improvement in the long-term operability of a framing projector or the like employing adjustable framing shutters. Although adding minimally to the cost of the unit, the shutter lock feature enables the unit to be retained in its initially adjusted condition for as long as needed, without concern for unintended repositioning of the framing shutters over time.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A specialized lighting fixture of the type comprising a lamp housing enclosing a source of illumination and a plurality of framing shutters for shaping and confining a light beam emitted by said fixture, wherein (a) said framing shutters are mounted in said housing for radial and/or tilting adjustment with respect to said housing and have first portions extending outward from said housing and hand grip portions at outer ends of said first portions for manually gripping and adjusting said framing shutters, (b) said housing includes friction elements engaging said framing shutters and permitting said framing shutters to be adjusted by an operator, and tending to retain said shutters in adjusted positions in which they are set by the operator, and which further includes (c) first and second locking plates, independent of and separate from said friction elements, generally surrounding said housing and positioned respectively on opposite sides of the outwardly extending first portions of said framing shutters and arranged to bear against said portions, and (d) releasable locking elements engaging said locking plates for causing said locking plates to apply clamping pressure to said outwardly extending first portions and thereby locking said framing shutters against movement from their adjusted positions with respect to said housing.

2. A specialized lighting fixture of the type comprising a lamp housing enclosing a source of illumination and a plurality of framing shutters for shaping and confining a light beam emitted by said fixture, wherein (a) said framing shutters are mounted in said housing for radial and/or tilting adjustment with respect to said housing and have first portions extending outward from said housing and hand grip portions at outer ends of said first portions for manually gripping and adjusting said framing shutters, (b) said housing includes means for frictionally engaging said framing shutters whereby said shutters tend to remain in adjusted positions in which they are set by an operator, and which further includes (c) first and second locking plates generally surrounding said housing and positioned respectively on opposite sides of the outwardly extending first portions of said framing shutters and arranged to bear against said portions, and (d) releasable locking elements engaging said locking plates for causing said locking plates to apply clamping pressure to said outwardly extending first portions and thereby locking said framing shutters in their adjusted positions with respect to) said releasable said housing, (e) locking elements comprise at least one locking element engaging said locking plates in a region between each adjacent pair of framing shutters, and (f) said locking elements comprising locking screws engaging said locking plates.

3. A specialized lighting fixture according to claim 1, wherein (a) said locking plates comprise elements of closed configuration having at least portions thereof in close contact with said housing to position said plates with respect to said housing.

4. A specialized lighting fixture according to claim 3, wherein (a) said housing is of generally circular cross sectional configuration, and (b) said locking plates comprise generally circular, ring-like members having a close fitting relationship with said housing.

5. A specialized lighting fixture according to claim 1, wherein (a) said framing shutters comprise thin sheet-like elements including integral portions thereof projecting generally radially from said housing and forming said outwardly extending first portions.

6. A specialized lighting fixture according to claim 1, wherein said first and second locking plates engage and secure a plurality of said framing shutters.

7. A specialized lighting fixture according to claim 1, wherein said first and second locking plates engage and secure all of said framing shutters.

* * * * *